US006003159A

United States Patent [19]

Sadegh et al.

[11] Patent Number: 6,003,159

[45] Date of Patent: Dec. 21, 1999

[54] APPARATUS FOR AUTOMATIC WASHING, SANITIZING AND DRYING TOILET SEATS

[76] Inventors: Ali M. Sadegh, 787 Oneida Trial, Franklin Lakes, N.J. 07417; Meisels Chaskel, 1415 46th St., Brooklyn, N.Y. 11204; George I. Lebovits, 8 Ronald Dr., Monsey, N.Y. 10952

[21] Appl. No.: 09/157,293

[22] Filed: Sep. 18, 1998

[51] Int. Cl.[6] ..... H47K 13/00

[52] U.S. Cl. ..... 4/233

[58] Field of Search ..... 4/233

[56] References Cited

U.S. PATENT DOCUMENTS

| | | | |
|---|---|---|---|
| 4,980,931 | 1/1991 | Meisels | 4/233 |
| 5,022,098 | 6/1991 | Brower | 4/233 |
| 5,119,517 | 6/1992 | Chans | 4/233 |
| 5,642,531 | 7/1997 | Holtom et al. | 4/233 X |

*Primary Examiner*—Charles E. Phillips
*Attorney, Agent, or Firm*—Richard A Joel, Esq

[57] ABSTRACT

An apparatus for automatically washing, sanitizing and drying a toilet seat. The apparatus comprises a toilet seat cover having independent fluid and gas conduits, a toilet seat and a runoff pan means, a control unit box and means for connecting the fluid and gas supply lines from the control unit box to said toilet seat cover. The toilet seat and the toilet seat cover and the runoff pan are pivotally connected by a hinge means and can independently move to an up or down position. Upon closing, toilet seat cover means are provided for automatically initiating the washing and drying cycles after each use. The control box unit further comprises an electric process unit including means to control and adjust the starting and finishing time of washing and drying cycles. The toilet system is sealed during the washing cycle to avoid splashing the fluid out of the toilet system.

3 Claims, 11 Drawing Sheets

APPARATUS FOR AUTOMATIC WASHING, SANITIZING AND DRYING TOILET SEATS

BACKGROUND OF THE INVENTION

The present invention relates to an apparatus for automatically cleaning toilet seats in public and private rest rooms. Specifically, it pertains to washing, sanitizing and drying a toilet seat after each use.

Toilet seats have the potential to transmit infectious diseases from one user to another. In recent years, the importance of toilet seat hygiene, in particular, of public toilet seat hygiene has come to people's attention and there is a great public awareness. Thus, there has been interest in insuring the cleaning, sterilizing and drying of all toilet seats. To maintain the required hygiene standards, many different methods have been utilized, many of which have not been applied on a large scale because of their various disadvantages. Therefore, a great majority of private and public toilet seats are still manually washed and dried and on an intermittent basis.

There are various methods of cleaning and subsequently drying a toilet seat using a fluidics agent and gas. The preferred fluidics agent is a combination of water and a suitable chemical such as sterilizing agent that is used for cleaning and disinfecting the toilet seats.

In surveying the prior art, cleaning and sterilizing toilet seat devices are disclosed which have the significant disadvantage of being expensive and impractical to use. In general, these devices are extremely complicated, heavy and in many cases cannot be easily retrofitted to the present toilet system. Furthermore, most of these prior art provide limited of washing, sterilizing and drying and they are inconvenient to use. For example, U.S. Pat. Nos. 4,980,931 to M. Chaskel, 3,837,018 to W. Haberle, 5,022,097 to P. Pusic, 4,853,982 to A. Martinval, 4,063,316 to K. Hunninghaus, and 4,924,532 to D. Pennestri all are illustrative of such prior art. None of the cited cleaning devices, while may be suitable for the particular purpose which they address, provide a satisfactory solution for fast and inexpensive toilet seat washing, sanitizing. Many of them require some major changes in existing toilet structures. Further, none of the cited toilet seat cleaning systems use a separate conduit for the gas and fluid agents, or seal the seat while it is being washed and dried.

In view of the foregoing, there exists a need for a toilet seat cleaning system which provides cleaning, sterilizing and drying and which provides a universal and highly versatile system for home usage as well as public rest rooms. Therefore, the object of this invention is to provide an improved and an automated cleaning, sanitizing and drying apparatus which can be easily retrofitted to the present toilet systems in private and public rest rooms.

An object of the present invention is to provide an automatic system for cleaning, sterilizing and drying a toilet seat that is economical, easily retrofitted to the present toilets and will overcome the limitations, disadvantages and shortcomings of the prior art devices.

Another object of the invention is to provide an automatic toilet seat cleaning system embodying improved and advanced principles of design and construction.

A further object of the invention is to provide means to use water from the regular water main and through a specific conduit spray a fluid agent on all the surface areas of the seat wherein a user's skin comes in contact with and thus effectively clean and sterilize the seat.

Another object is to have a separate gas conduit for drying and deodorizing the seat.

A further object of the invention is to provide means to use electric power from the regular electric outlet for drying and deodorizing toilet seats through the gas conduit.

A still further object is to provide means to adjust and control the starting and finishing times of the cleaning, sterilizing, drying and deodorizing processes.

It is another object for the present invention to provide a system for cleaning and sterilizing, drying and deodorizing that is self contained and will not splash any fluid outside the toilet bowl during operation.

SUMMARY OF THE INVENTION

This invention relates to an apparatus which automatically washes, sanitizes and drys a toilet seat, can be retrofitted and is compatible with present toilet systems. The automatic toilet seat cleaning system, according to the principles of this invention, comprises a toilet seat, a toilet seat cover, a runoff pan or water collector and a control unit. The toilet seat cover comprises of three separate conduits utilized for fluid and gas agents. The two fluid conduits are located in the inner and the outer rims of the seat cover and have small holes for the impingement of fluid against the toilet seat on the outer and the inner areas to ensure that the complete surface of the seat is washed. The third conduit which is used for gas or hot air, is located in the middle rim of the cover and has larger openings to ensure the proper flow of gas or hot air to dry the seat.

The toilet seat comprises a water collector and a seat which are separated through a spacer that creates a fluid passage to the toilet bowl. By closing the toilet seat cover, the outer edge of the seat cover fits into the inner edge of the water collector thereby sealing the toilet and the water collector. The sealing of the toilet permits the fluid to dispense, through small holes, with great force against the seat.

The control unit comprises an automatic electric or electronic means that provides two cycles: a cleaning and sterilizing cycle with the fluid; and a drying cycle. The control unit further comprises an automatic fluid control valve that is connected to a water source, a chemical mixing chamber, and a blower means with a heating element which is used for the drying cycle. The control unit further comprises a central process unit which controls and adjusts the starting and finishing time of the washing and drying cycles.

An alternative design of the toilet seat cover comprises a fluid conduit and a planar channel conduit within the seat cover. The fluid conduit is located in the outer rim of the seat cover having small holes for the impingement of the fluid against the toilet seat. The planar channel conduit delivers the gas to a multiplicity of openings located on the periphery of the seat cover. The alternative design of the toilet seat also comprises a runoff pan and a seat that are pivotally connected.

Further objects and advantages of this invention will become apparent upon consideration of the drawings provided.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
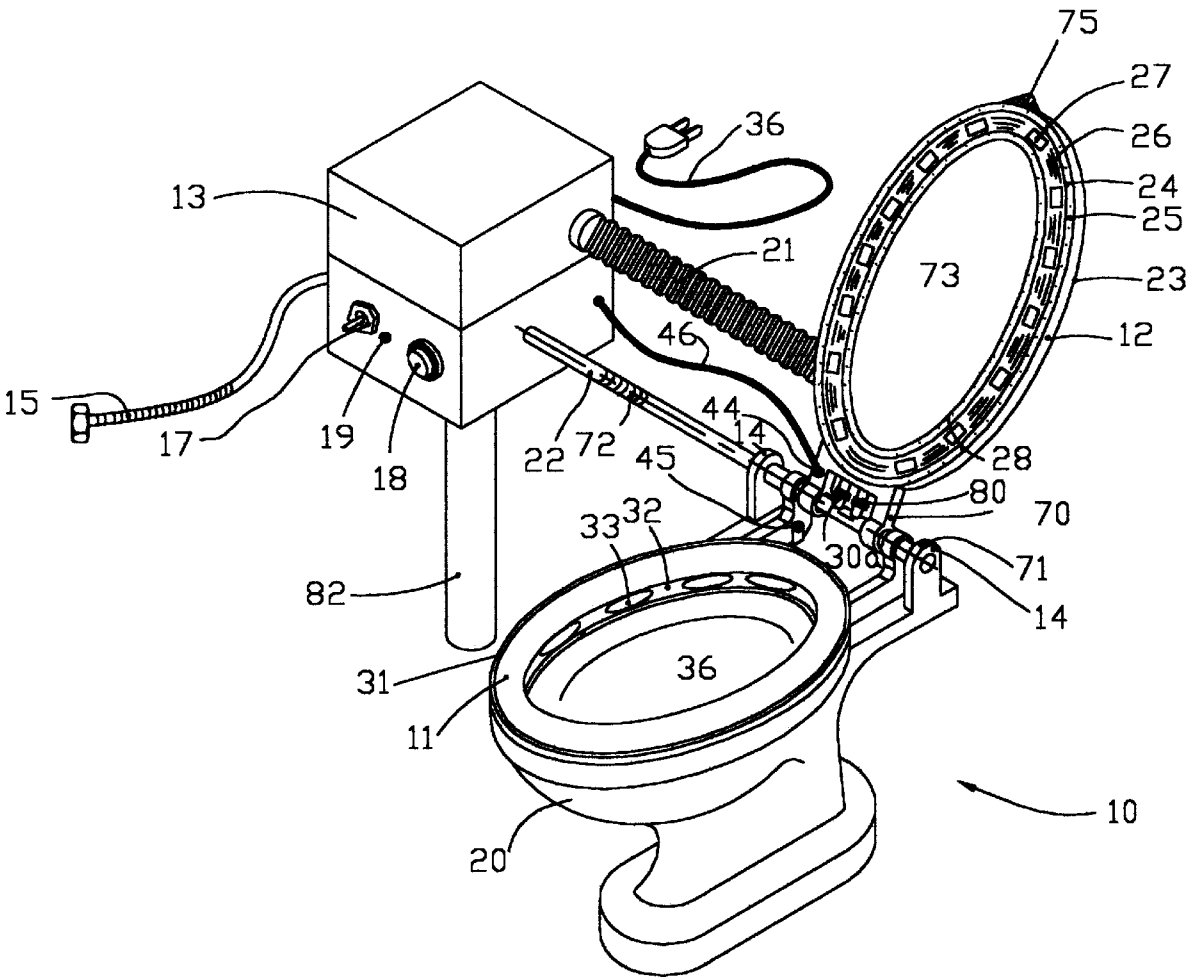
FIG. 1 is a perspective view of the present invention showing the overall toilet seat system in an open configuration.

Referring now to the drawings, the exemplary embodiment of the invention as described in FIG. 1–10 illustrates the toilet seat cleaning apparatus 10 in accordance with the teachings of the present invention.

Referring to FIGS. 1–4 the apparatus 10 generally comprises a toilet seat 11, a toilet seat cover 12 that is pivotally connected to seat 11 by a hinge means 14, a control unit 13 and a bowl 20. The control unit 13 is connected to a water supply by a flexible tube 15 and to an electric supply by an electric wire 36. The control unit 13 provides a sterilizing fluid for washing and disinfecting the toilet seat by a tube means 22 that is connected to the seat cover 12 through hinge 14 and two connecting pipes 30 and 30*a*. The tube means 22 comprises flexible tubing 72 for ease of connecting control unit 13 to seat cover 12. The control unit 13 is connected through a flexible tube means 21 to a port means 29 which is rigidly attached to the toilet seat cover 12. The unit provides a gas means, preferably odorized hot air, for drying and deodorizing the toilet seat system 10.

Figure 2:
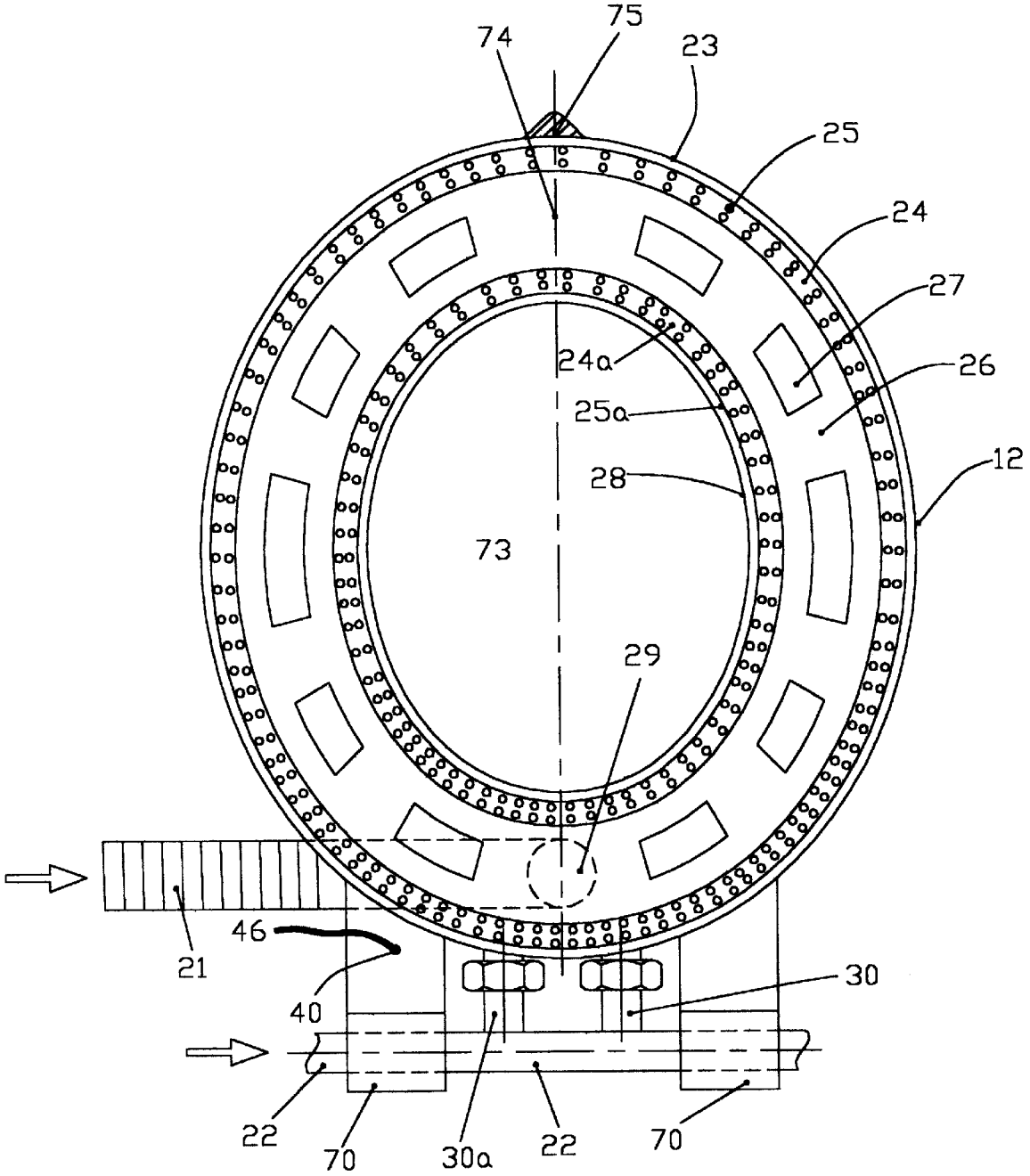
FIG. 2 is a bottom view of the toilet seat cover showing the gas and fluid conduits.
Figure 4:
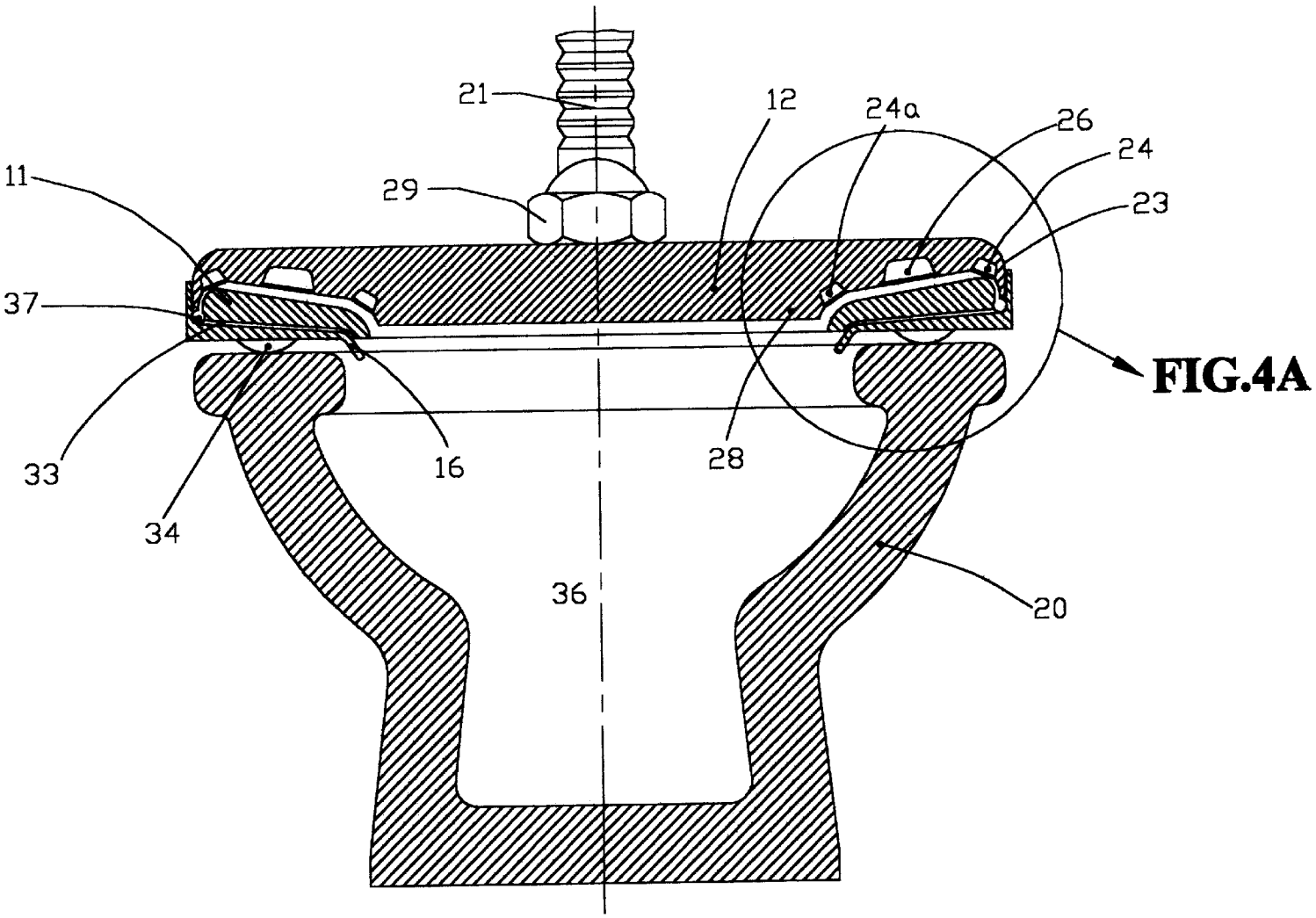
FIG. 4 is a cross-sectional view of the toilet seat in the closed or down position.

As shown in FIGS. 2 and 4, the toilet seat cover 12 comprises an embodiment 73 that is rigidly connected to a hinge 70 through which fluid pipe 22 passes. The seat cover 12 includes a fluid conduit 24 located in an outer rim 23 and a fluid conduit 24*a* located in an inner rim 28 of seat cover 12. The fluid supply 22 is rigidly connected to fluid conduits 24 and 24*a* by two piping means 30 and 30*a*, respectively. The exterior surface of the fluid conduits 24 and 24*a* include a multiplicity of small outlet openings such as 25 and 25*a*, respectively, that are spaced apart, randomly or in an organized fashion, along the inner and outer periphery of the exterior surface as measured between the two ends thereof. The openings 25 and 25*a* are for fluid impingement on the surface of the seat for cleaning purposes.

The seat cover 12 further includes a gas conduit 26 located in the middle of the two fluid conduits 24 and 24*a*. The flexible gas supply 21 that is rigidly connected to cover seat 12 through connecting port 29 provides gas for conduit 26. The exterior surface of gas conduit 26 includes a multiplicity of large openings such as 27 that are spaced apart. Because of the friction of the gas flow within gas conduit 26, the gas pressure drops as it flows from the connection port 29 to the distal region 74 of cover seat 12. Therefore, the size and shapes of openings 27 may vary in order to have a uniform pressure distribution of the gas on the surface of seat 11.

Figure 3:
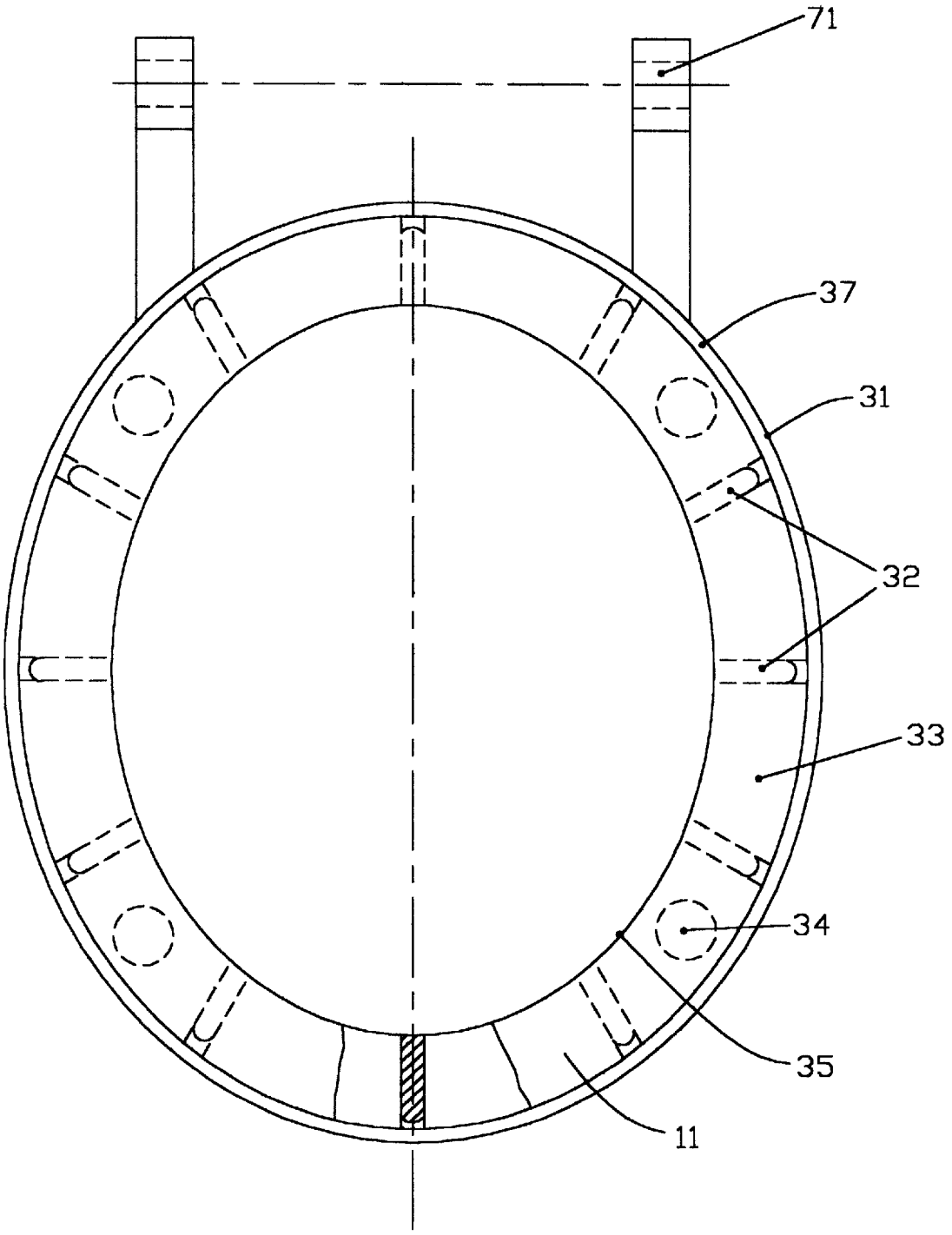
FIG. 3 is a top view of the toilet seat showing the locations of the drainage passages of the collector and the spacers between the seat and the collector and also, showing a fragmentary section of the spacer.

To insure that the cleaning and sterilizing fluid flows off into the toilet bowl, as best described with reference to FIGS. 3 and 4, seat 11 includes run off collector means 37 at the outer edge of seat 11 and a multiplicity of passages conduit means, such as conduit 33, that are spaced apart under along the circumferential length of seat 11 for drainage of the fluid into a toilet 36. The seat 11 that includes passage 33 is separated from bowl 20 by four spacers means 34 and is connected rigidly to a hinge 71 through which fluid pipe 22 passes.

Figure 4A:
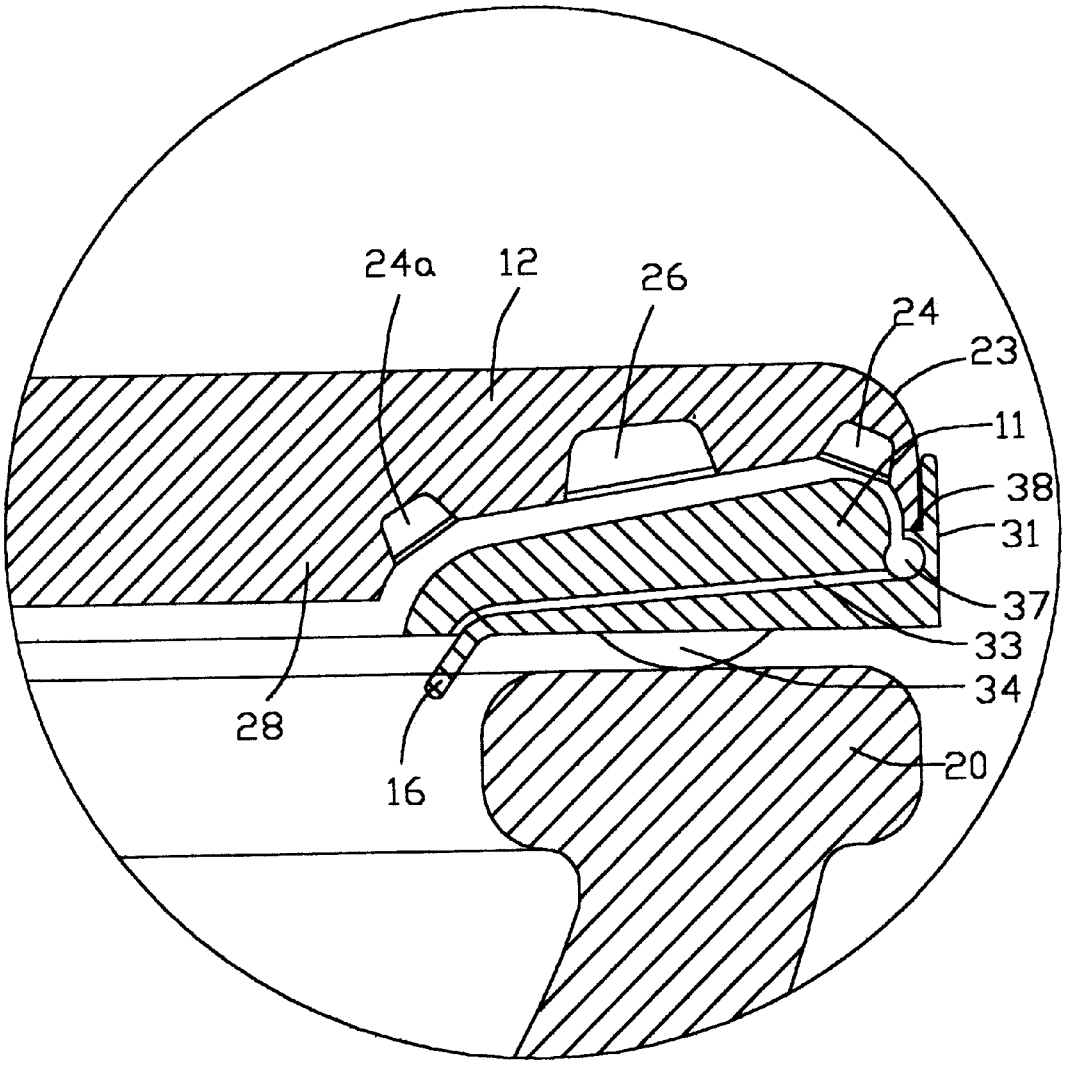
FIG. 4*a* is an enlarged fragmentary section of the outer edge of the toilet seat in the closed position showing the sealing of the outer edge of the seat taken along the lines 4—4 of FIG. 3.

According to a particular advantageous embodiment of the present invention, the toilet system provides a sealing means for the fluid agent which prevents splashing out of the toilet and onto the floor and other adjacent fixtures. As shown in FIG. 4A, the outer edge 31 of seat 11 includes a L-Shaped step means 38 wherein an outer edge 23 of cover 12 rests on seat 11. The sealing means 38 may have variety of shapes and forms and functions similar to a tongue and groove construction. When the cover is closed, with the least amount of lifting force on a small handle means 75 the cover opens.

The opening and closing seat cover 12 may be automated by an electric motor means (not shown) which is activated by the water level in the toilet's tank once it is flushed. Also, seat cover 12 may be opened by a rope (not shown) associated with a water level in the tank.

Figure 9:
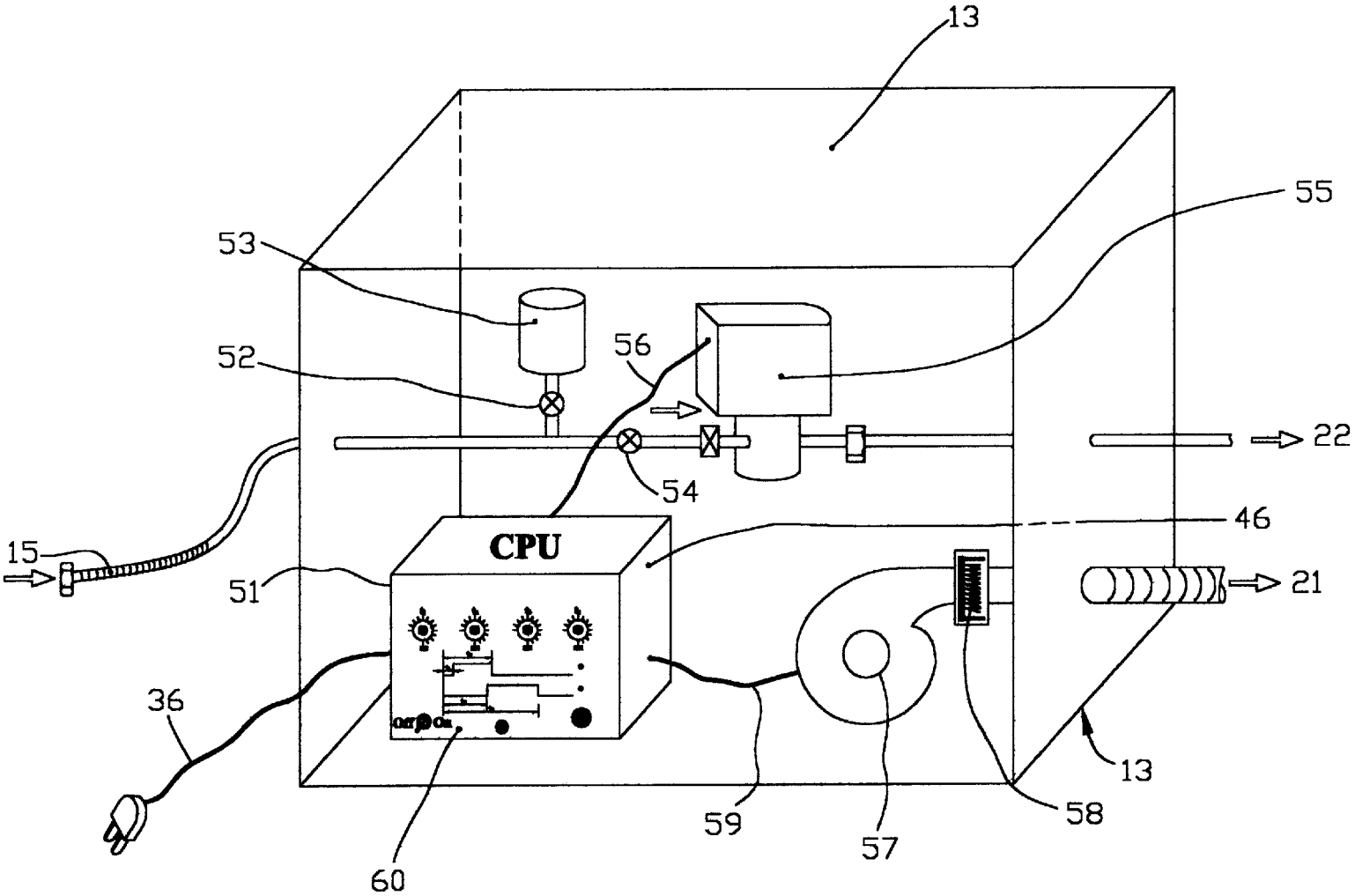
FIG. 9 is a perspective view of the inside of the control unit box of the toilet seat system showing the solenoid, central process unit and blower configurations.

The cleaning and drying of the toilet seat is performed electrically guided by the system's control unit 13, shown in FIGS. 1 and 9. To avoid any contact of electricity and water and any hazardous situations, all electric components, inside and outside of control unit 13, are properly isolated and insulated. The control unit 13 is supported by a stand 82.

Figure 10:
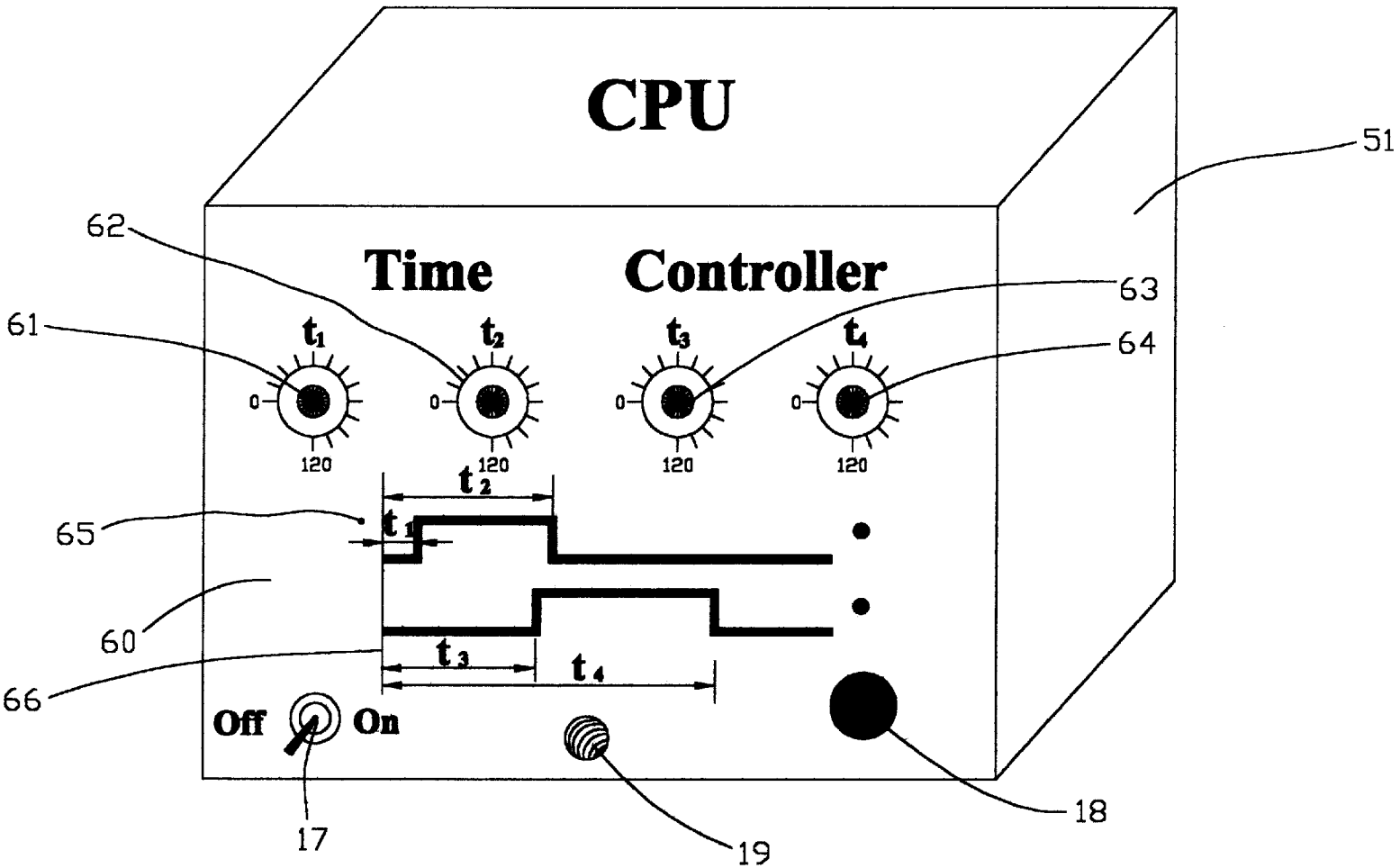
FIG. 10 is an enlarged view of the control panel of the central processing unit showing the adjustment knobs and the corresponding time intervals.

As shown in FIG. 10, the control unit 13 comprises an On-Off switch means 17 on the exterior, a push button means 18 and an electric-eye (photo sensor means) 19. As shown in FIG. 9, the control unit 13 also includes a sterilizing fluid reservoir 53 that is connected to a check valve 52 and subsequently to the water feed line 15. A check valve 54 is placed on water feed line 15 before a solenoid valve 55. The output tube of solenoid valve 55 is delivery tube 22. The control unit 13 further comprises a blower means (a gas pump) 57, an electric heating element 58 that is located on the output line of blower 57 to provide hot air into gas delivery line 21. The control unit 13 further comprises a Central Process Unit (CPU) 51 which is electrically connected to solenoid valve 55 by an electric wire 56, and which is also connected to blower 57 by an electric wire 59. A push button "On-Off" switch means 44 is located on hinge area 70 of seat cover 12 and is electrically connected to CPU 51 by an electric wire 46. Upon closing seat cover 12 switch means 44 comes in contact with an object means 45 located on the toilet bowl thereby pushing 44 inwardly and closing the electric circuit allowing the washing cycle to start.

CPU 51 comprises a time controller cover panel 60 which includes four adjusting knob means 61, 62, 63 and 64 each of which controls a time t1, t2, t3 and t4, respectively. A washing and sterilizing cycle is shown in a diagram 65 where t1 is the delayed time for starting of the cycle and t2 is the time for completing the cycle. A drying and deodorizing cycle is shown in a diagram 66 where t3 is the delayed time for the start of drying cycle and t4 is the time for completing the cycle. Each of the delay times or the completion times of the two cycles can be independently adjusted according to the need of the user. To increase the time, each of knobs 61–64 is turned clockwise from zero second to 120 second and to decrease the time each of the knobs is turned counterclockwise. The maximum time of 120 second is a recommendation and may be changed accordingly.

To start the washing and drying process, first the On-Off switch 17 must be on the ON position. To avoid splashing the fluid, the circuitry (signal) from the On-Off switch 44 should be closed which indicates that toilet seat cover 12 is closed. According to the user's need the cycle times t1–t4 are selected.

Then CPU 51 is activated by either the manual push button 18 or the electric eye (a photo sensor) 19 after each use. In public toilets electric eye 19 is used as an automatic mode operation to ensure washing and drying after each use. In private toilets, to save energy, the push button 18 may be used for washing and cleaning as needed.

Figure 5:
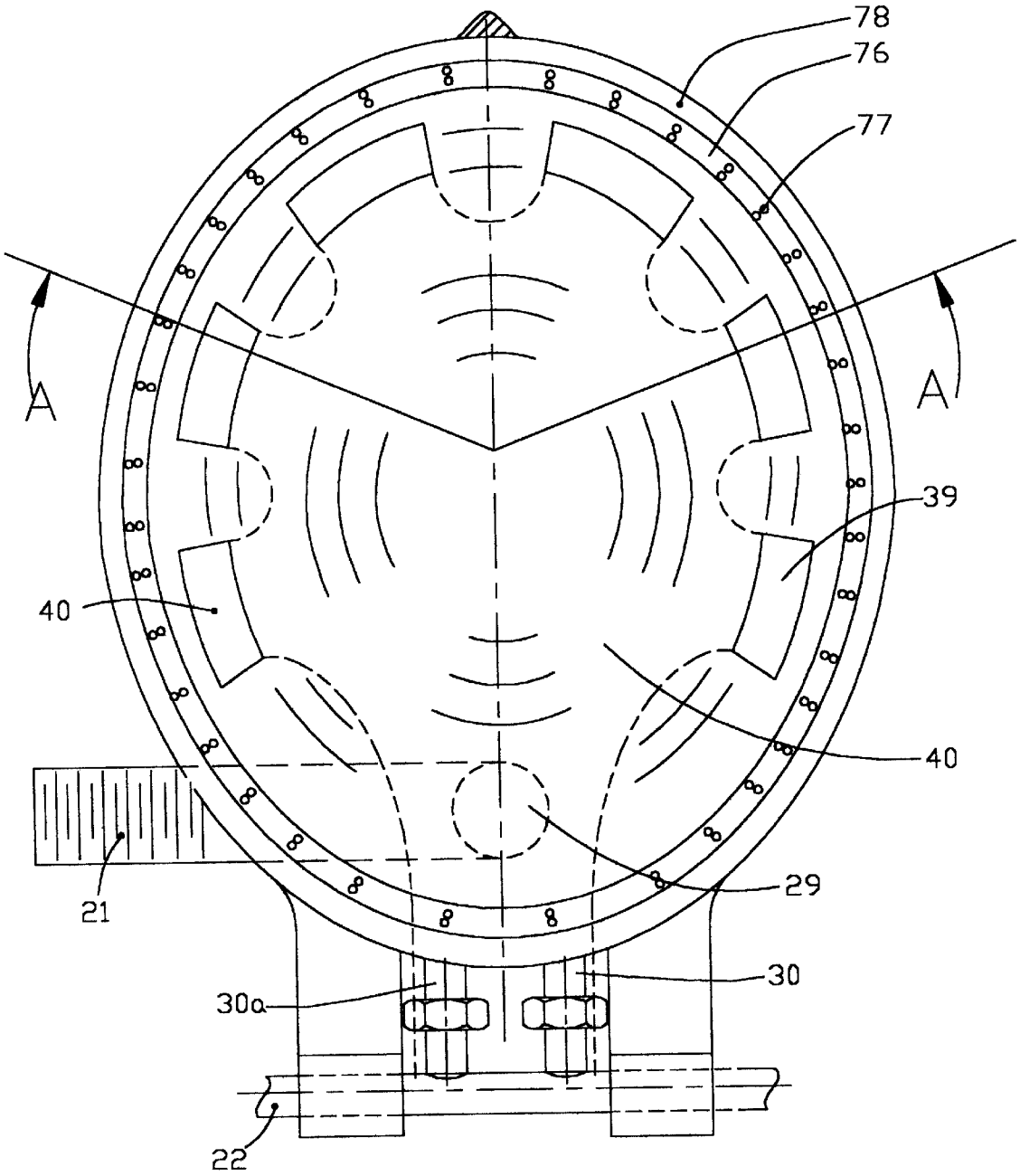
FIG. 5 is a bottom view of an alternative design for the toilet seat cover, in particular the planar gas conduit and the openings.
Figure 6:
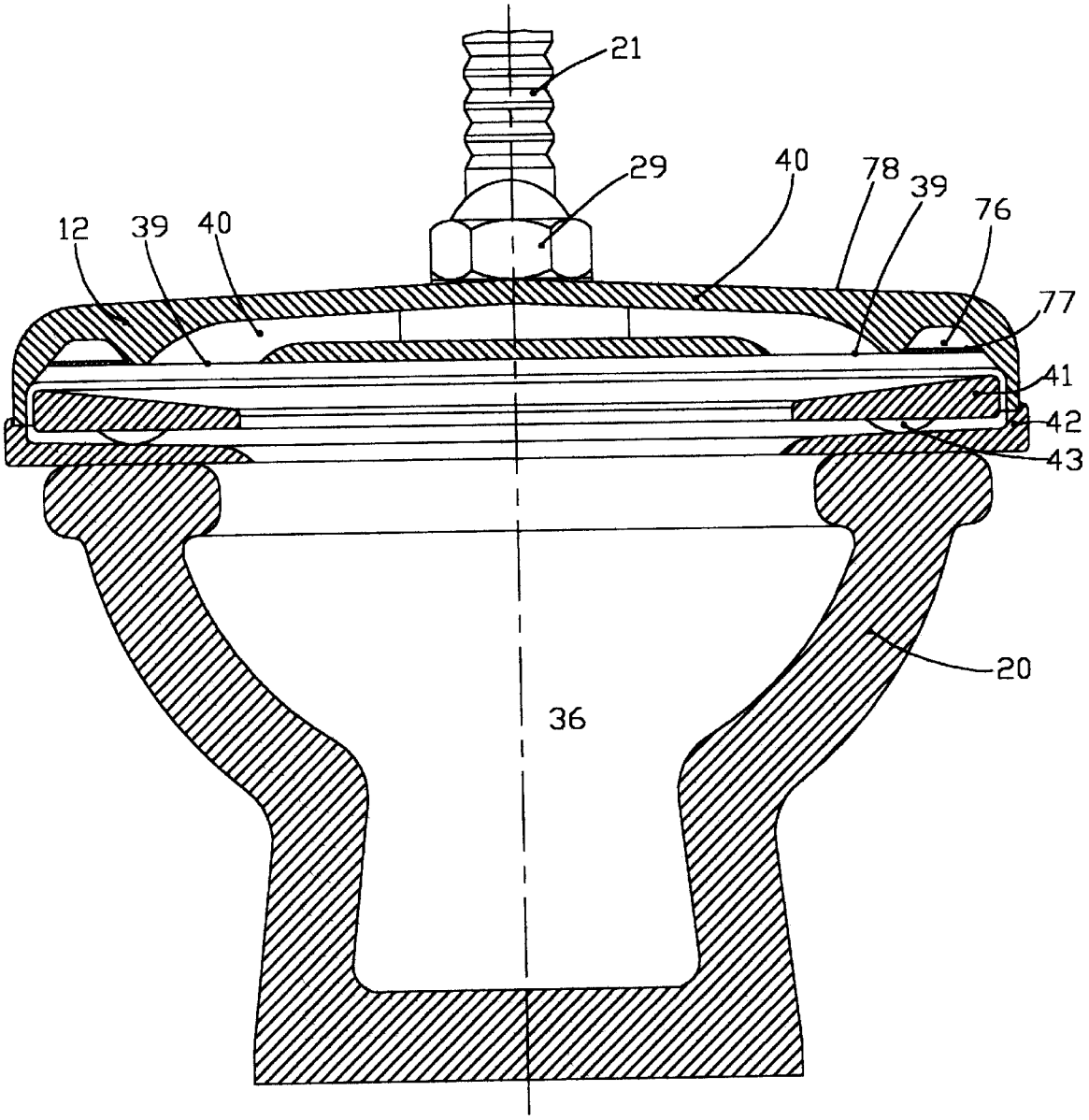
FIG. 6 is the cross-sectional view 6—6 of FIG. 5, the alternative design, showing a runoff pan separated from the seat by the spacers.
Figure 7:
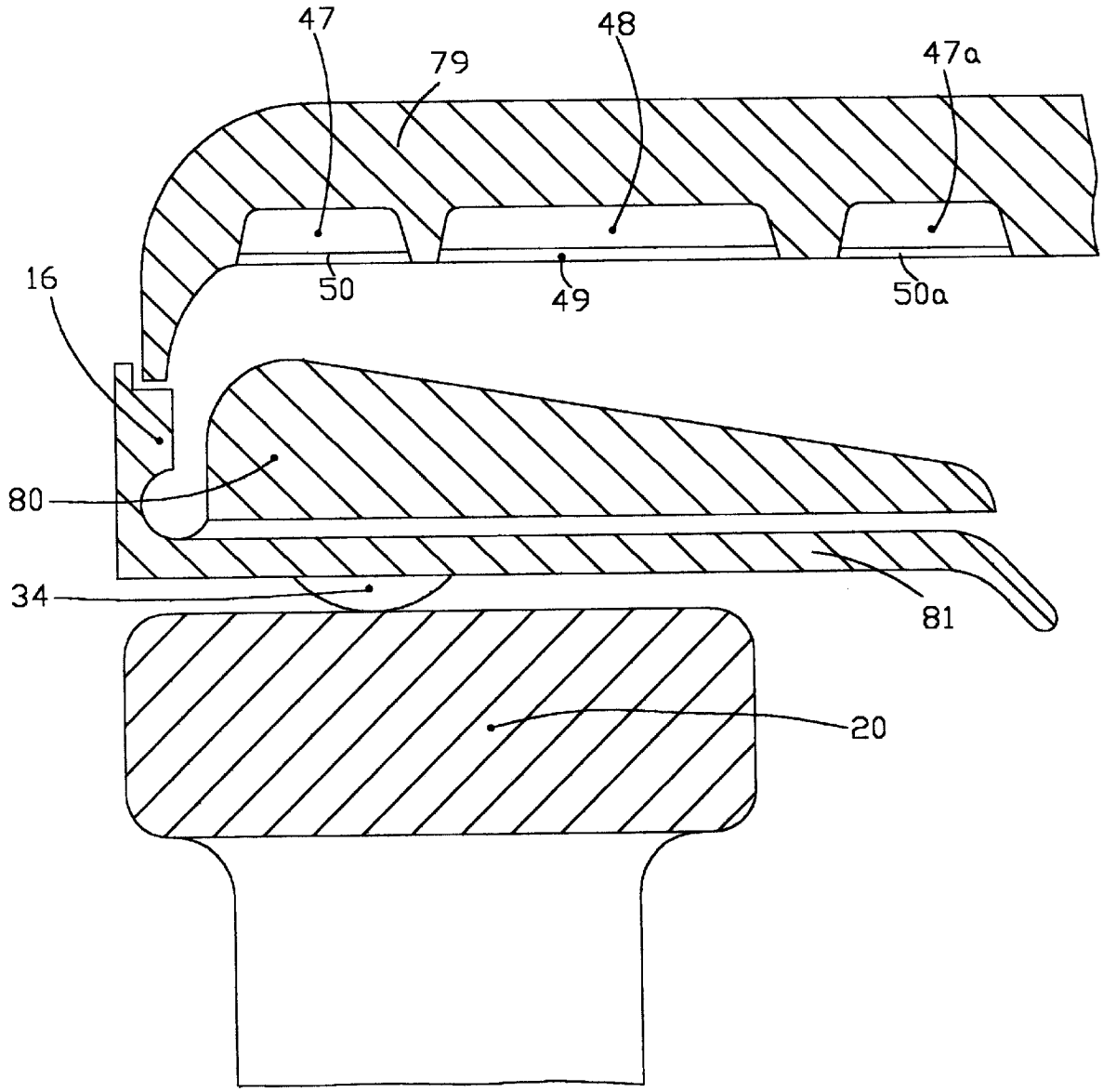
FIG. 7 is an enlarged fragmentary section of another alternative design for the configuration of the fluid and gas conduits with the seat taken along the line of 7—7 of FIG. 6.
Figure 8:
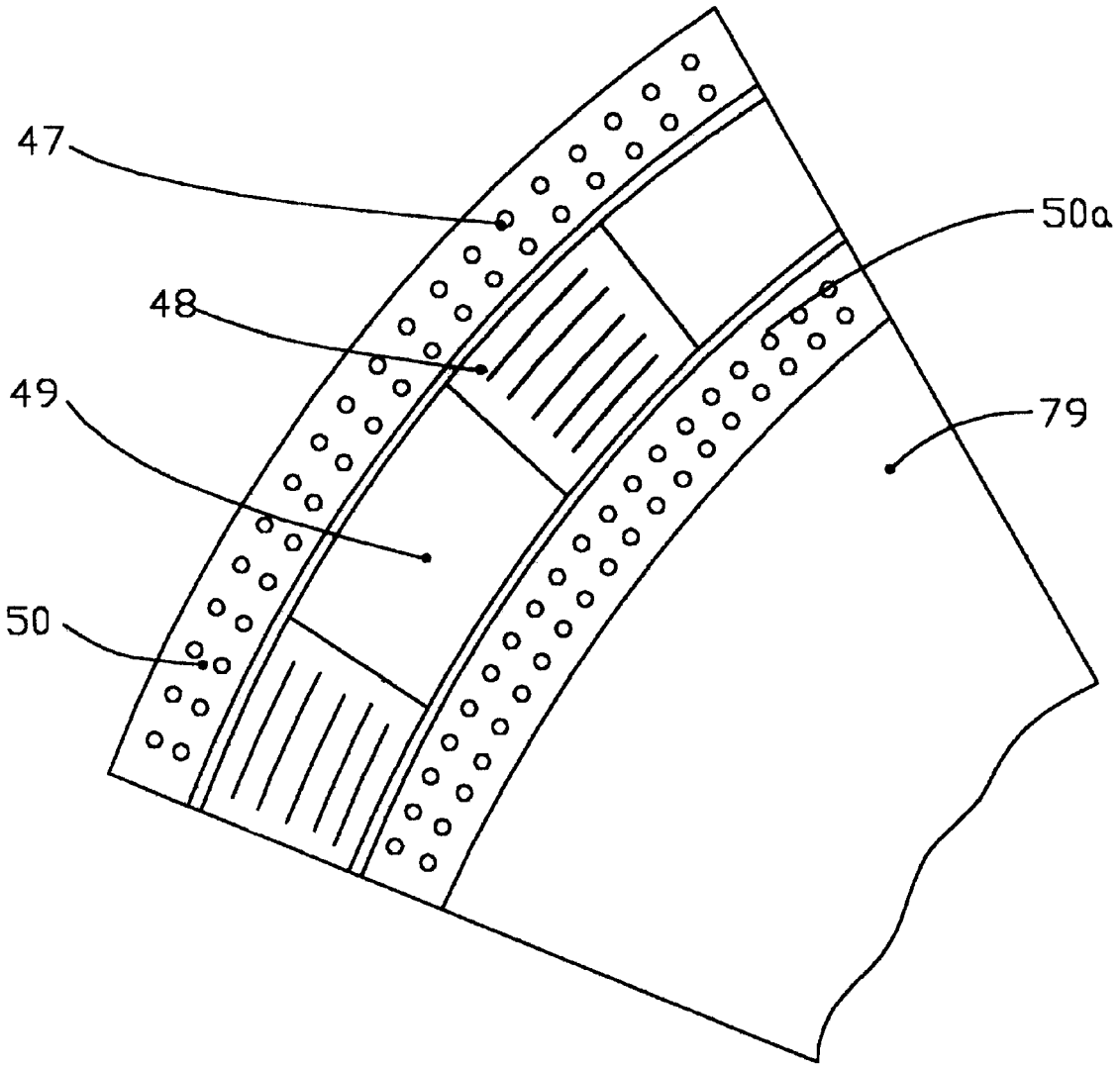
FIG. 8 is an enlarged fragmentary bottom view of the cover seat of the alternative design shown in FIG. 7.

A further embodiment of the present invention consists of alternative designs of a seat cover 78 as shown in FIGS. 5 and 6. To improve gas pressure distribution, a planar gas conduit (channel) 40 connects gas feed line 21 to openings 39. The channel 40 is a planar opening within the cover seat 78. To distribute the gas pressure uniformly some islands within the gas conduits (not shown) may be used to direct the gas flow to a specific opening. The seat cover 78 includes a fluid conduit 76 located in an outer rim of seat cover 78. The exterior surface of the fluid conduit 76 includes a multiplicity of small outlet openings such as 77 that are spaced apart, randomly or in an organized fashion, along the length dimension of the exterior surface as measured between the two ends thereof. The openings 77 are for fluid impingement on the surface of the seat for a better cleaning purpose. The fluid supply lines 30 and 30*a* are rigidly connected to fluid conduits 76. To have access to the drainage passage, and to lift the toilet seat independent of the water collector, as an alternative design said toilet system 10 comprises a runoff pan 42 (a water collector) that is separated from a seat 41 by a spacer 43, as shown in FIG. 6.

To simplify the manufacturing of seat cover 12, the locations and configurations of the fluid conduits 24 and 24*a*, and the gas conduits 26 may be varied from a circular tubing to a flat rectangular cross section. As an alternative design, a further embodiment of the present invention consists of a seat cover 79 which comprises fluid conduits 47 and 47*a* and a gas conduit 48 that are configured on the same thickness of seat cover 79 as best described in FIGS. 7 and 8. Fluid openings 50 and 50*a* similar to 25 direct the fluid forcefully against a toilet seat 80. The fluid is then drained to toilet 36 by a run off collector means 81. Gas openings 49 similar to 27 deliver the hot air to a seat 80 for drying and deodorizing.

Thus, an automated apparatus for cleaning and sterilizing toilet system has been described which is novel in both form and function and which is useful for private and public use and is operated in a manual or automatic modes, and can be newly constructed or adapted and mounted in existing toilet bowls. Further the disclosed apparatus unlike the prior art cleans and sterilizes the entire seat while it is completely sealed and there is no splashing of the water.

While the invention has been explained by a detailed description of certain specific embodiments, it is understood that various modifications and substitutions can be made in any of them within the scope of the appended claims which are intended also to include equivalents of such embodiments.

What is claimed, is:

1. An automated washing, sanitizing and drying apparatus for a toilet including a toilet bowl comprising:

a toilet seat having an outer perimeter and an inwardly inclined upper surface to be disposed on a rim of a toilet bowl having an inner receptacle, said toilet seat having a lower flange around its periphery and an open annular conduit therein, said toilet seat further having a plurality of spaced drainage passages within said seat for connecting said annular conduit to said inner receptacle of said bowl, said toilet seat having a hinge at its proximal end;

a fluid supply and air supply;

a toilet seat cover having an outer periphery and a lower annular surface, said cover having an outer annular fluid conduit around its periphery and an inner annular fluid conduit around the annular surface each including a multiplicity of apertures extending from said conduit to the upper surface of the seat for spraying the fluid from a fluid supply on the toilet seat, said cover having an annular gas conduit positioned between the two fluid conduits, said gas conduit having multiplicity of large openings for blowing hot air from an air supply on the toilet seat, said toilet seat cover being pivotally connected to said seat through a hinge means at its proximal end;

a control unit box that governs the starting and ending time of the washing and drying cycles and comprising, (1) a housing, (2) a stand for support of said control unit box, (3) a frontal panel having an On-Off manually operated switch means for turning the control unit and the toilet cleaning system on or off, and a push button switch means to start a cleaning cycle, and an electric eye or a photo sensor means for automatic signaling the control unit box to start the cleaning cycle, (4) a fluid supply tube that is connected to the fluid supply, and means connecting the control unit to an electric power source;

a flexible air tube that is connecting the output of air said control box to the gas conduit of said toilet seat cover through a sealed port, and a fluid tube having a flexible tube connecting an output fluid of said control box to said toilet seat cover through a hinge on said toilet seat that pivotally connects the seat and the cover, said hinge rotating about the fluid supply conduit; and, a push button switching means located on the hinge of the toilet seat cover having means connecting the switch to said control unit box, and a flexible stopper means located on the hinge of the toilet seat where in a down position of the toilet seat cover the stopper comes in contact with the push button of the cover, closing the circuit for starting the washing cycle.

2. The system according to claim 1, wherein the housing of said control unit box comprises:

a sterilizing fluid reservoir, a check valve connected thereto, an input fluid line, a solenoid valve providing that is electrically activated and opens or closes the fluid line leading to the fluid conduit in said toilet seat cover, a gas fan blower means that provides pressurized air supply for the drying cycle of the system, and an electric heater means located within the output gas conduit of said blower mean for heating the air, a digital or analog Central Processing Unit (CPU) means for controlling the starting and ending times of the washing and drying cycles, said CPU having four adjusting means to control the four time intervals, each of the adjusting means setting the time from zero to a desired value, and upon adjusting an electric signal is generated to start the solenoid valve or the blower.

3. The system according to claim 1, wherein said toilet seat has a peripheral step upwardly extending rim sealing means such that in a down or closed position the toilet seat cover is positioned within the rim sealing means which mates with the rim and seals the system in a fluid tight manner.

* * * * *